United States Patent [19]

Cook et al.

[11] Patent Number: 4,871,204

[45] Date of Patent: Oct. 3, 1989

[54] TOUCH BAR RELEASE LOCKING SYSTEM

[75] Inventors: Robert C. Cook, Redondo Beach; Mark R. Barton, Los Angeles, both of Calif.

[73] Assignee: Securitron-Magnalock Corporation, Torrance, Calif.

[21] Appl. No.: 241,585

[22] Filed: Sep. 8, 1988

[51] Int. Cl.[4] ..... E05B 47/00

[52] U.S. Cl. ..... 292/251.5; 292/336.3; 70/276

[58] Field of Search ..... 292/251.5, 201, 144, 292/341.16, 336.3; 70/276, 277

[56] References Cited

U.S. PATENT DOCUMENTS

| | | | |
|---|---|---|---|
| 3,495,353 | 9/1968 | Forsberg | 49/25 |
| 3,496,381 | 5/1968 | Wisnia | 307/125 |
| 4,168,495 | 9/1979 | Sweeney | 340/546 |
| 4,287,513 | 9/1981 | Lam et al. | 340/562 |
| 4,652,862 | 3/1987 | Verslychen | 292/92 X |
| 4,682,801 | 7/1987 | Cook et al. | 292/251.5 |
| 4,763,937 | 8/1988 | Sittnick, Jr. et al. | 292/251.55 |

*Primary Examiner*—Richard E. Moore

*Attorney, Agent, or Firm*—Poms, Smith, Lande & Rose

[57] ABSTRACT

The touch bar release locking system includes a hollow metal channel which affixes to a door at two points via insulating spacer blocks. Within the channel is housed a capacitive sensor which functions by detecting the additional capacitance coupled to the hollow channel by the act of a person touching it (even through gloves or clothing). When the additional capacitance is detected, a relay energizes and actuation of the relay contacts releases an electric lock which had been securing the door, thereby providing free egress. In the event of catastrophic sensor failure, egress can still be accomplished by pressing an electromechanical push button, mounted on the rear of the hollow channel, which duplicates the effect of energization of the sensor relay.

18 Claims, 2 Drawing Sheets

FIG. 1
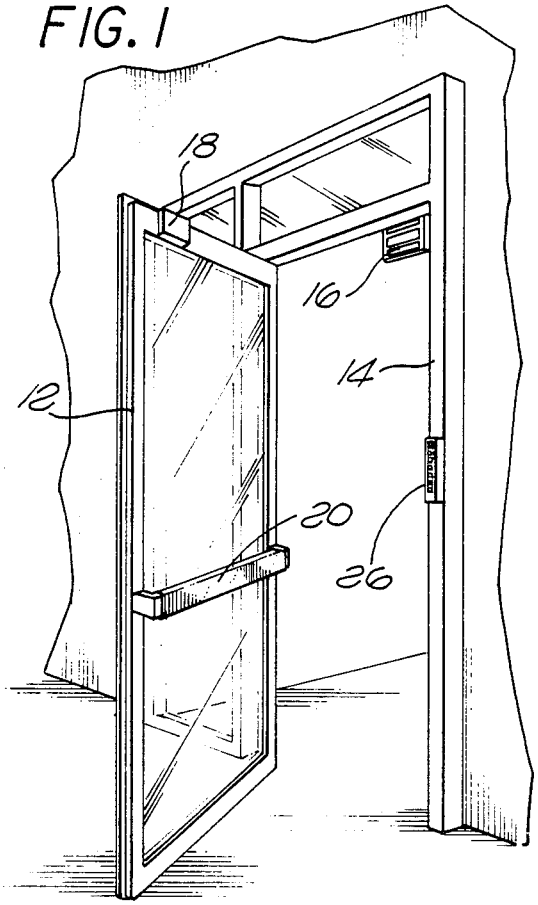
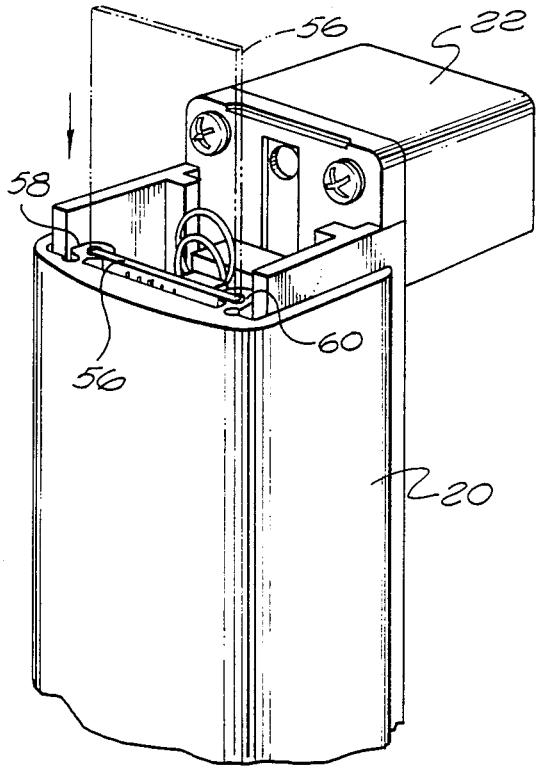
FIG. 5
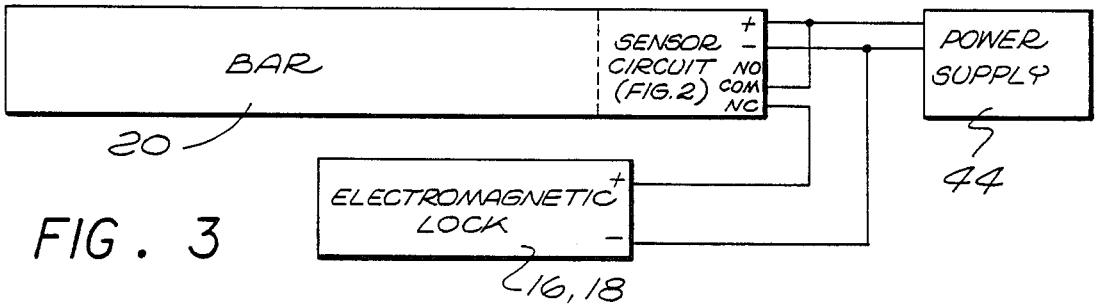
FIG. 3
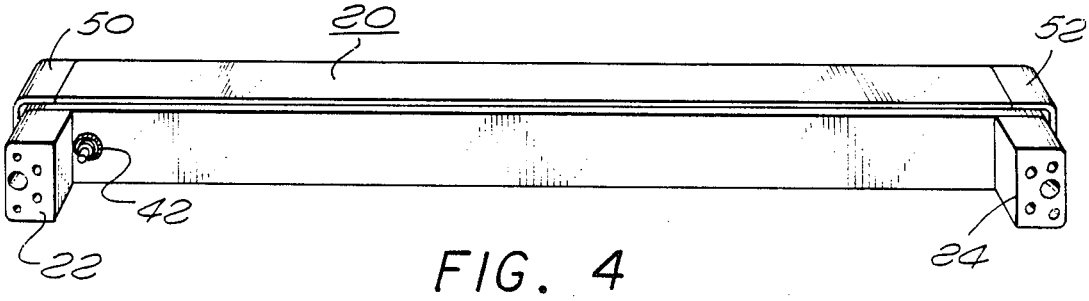
FIG. 4

TOUCH BAR RELEASE LOCKING SYSTEM

FIELD OF THE INVENTION

This invention relates to door locking systems using a capacitive bar for releasing the door lock.

BACKGROUND OF THE INVENTION

In recent years, the number of installations involving doors secured by electric locking devices has been increasing rapidly as part of the growth of the security market. Most installations of electric locks on doors consider that one side of the door constitutes a "protected area". Persons within this area can freely use the door for egress at any time. Indeed, building codes often require that free egress from the protected area be allowed by the equipment on the door. Entry from outside the protected area is generally restricted and various arrangements are used to insure that the person entering is authorized to do so. These arrangements include card reader systems, digital keypads, keyswitches and remote release after audio communication via an intercom or surveillance with a television camera.

If the electric locking device on the door is an electric strike, free egress is accomplished simply by turning a doorknob which retracts the latch from the electric strike. In other instances, a mechanical panic bar can be depressed to retract the latch. Increasingly, however, users demand higher security electric locking devices which are more capable of resisting a physical assault on the door. These devices include electric solenoid deadbolts and electromagnetic locks including a large electromagnet and a strike plate or armature.

Free egress from a door secured by an electric solenoid deadbolt or electromagnetic lock must include a switch changing state. Purely mechanical means will not release an electric lock. In some instances, a simple push button may be mounted alongside the door, but this is a poor solution, as a person wishing to exit may not know the function of the push button and the person will certainly not find it in a panic situation or in a situation where the lights have gone out. The product of choice, therefore, to allow free egress on a door equipped with an electric lock is a panic bar to which an electromechanical snap switch has been added such that depressing the bar activates the switch which, in turn, releases the electric lock.

Panic bars with switches however, suffer from a number of disadvantages. There are numerous moving parts which render the product costly to manufacture and highly subject to wear-related failure. Also, in a real panic situation, persons may become wedged against the door in such a way that the bar is jammed so that it cannot move. If the bar cannot move, it will not function to depress the switch.

The present invention seeks to replace switch equipped mechanical panic bars with an all electronic device. The present invention has no moving parts and does not suffer mechanical wear so that it has a much longer operating life and in general can be cheaper to manufacture. It will also function more reliably in a true panic situation as the risk of people getting wedged against the bar and therefore immobilizing it will not stop a touch sensitive bar from releasing the lock. Another benefit of the present invention is the redundant push switch which constitutes a secondary means of operation in the remote event that the sensor will fail.

Prior patents which have some relevance to the present invention include U.S. Pat. No. 4,682,801, issued July 28, 1987, and assigned to the assignee of this patent application. This patent is an electromagnet access control circuit and shows a circuit and a physical arrangement for an electromagnet and striker plate or armature locking arrangement. R. W. Forsberg, U.S. Pat. No. 3,495,353, granted Feb. 7, 1970, discloses the use of a touch plate beside a door, to energize a motor to open the door when the touch plate is touched. J. A. Wisnia, U.S. Pat. No. 3,496,381, granted Feb. 17, 1970, discloses a capacitive plate located in a position similar to a floor mat, and, like the Forsberg system causes the door to open when the capacitance increases by the presence of a person. Two patents relating to alarm systems which are energized by increased capacitance on a doorknob, are Sweeney, U.S. Pat. No. 4,168,495, granted Sept. 18, 1979, and H. C. Lam, et al., U.S. Pat. No. 4,287,513, granted Sept. 1, 1981. The foregoing patents have a certain subject matter which is vaguely related to the present invention, but none of them discloses a system which solves the problems as outlined hereinabove in the preceding paragraphs.

SUMMARY OF THE INVENTION

In accordance with a preferred embodiment of the present invention, a door is provided with an electromagnetic locking arrangement, such as a large electromagnet mounted on the frame of the door, and a striker plate or armature mounted in mating relationship to the electromagnet, on the door. When the electromagnet is energized, the door is locked closed. A conductive bar is mounted on the door by insulating blocks and the effective capacitance of the conductive bar is substantially increased when a person touches or pushes on the bar in order to open the door. A system is provided with switching arrangements for releasing the locking electromagnet and a circuit having an input which is sensitive to increased capacitance for operating the switch, with the conductive bar being connected to the input of the circuit. Accordingly, when a person approaches the bar on the door and pushes on it, the electromagnet is instantaneously released or is released in less than about 50 milliseconds and the door may then be opened by the user.

Additional features of the invention may include one or more of the following:

(1) The circuitry for sensing the increased capacitance and actuating the release of the electromagnetic locking arrangement may be mounted within the bar which is intended for mounting on the door.

(2) A push-button switch may be provided and mounted on the touch bar for emergency release of the electromagnetic locking arrangement in the event that the capacitive sensor should fail or become inoperative for any reason.

(3) The circuit may include the following elements:

(a) A flip flop for operating the switch to release the electromagnet with the flip flop circuit including a clock input and a variable input for changing the state of the flip flop only when the variable input follows the clock input;

(b) a square wave oscillator, and (c) circuitry for applying the output from the square wave oscillator to the clock input to provide a reference timing signal, and to the variable input with a delay dependent upon the capacitance seen at the touch bar, whereby persons touching the bar delay the variable input and change the state of the flip flop to release the electromagnet.

(4) The touch bar may be rectangular and may be mounted across the door with insulated block arrangements at each end, so that the bar is insulated from metal doors upon which it may be mounted.

Other objects, features, and advantages will become apparent from a consideration of the following detailed description and from the accompanying drawings.

BRIEF DESCRIPTION OF THE DRAWINGS

FIG. 1 shows a door equipped with a release touch bar and an electromagnetic lock including a large electromagnet on the door frame and an opposing striker plate or armature mounted on the door;

FIG. 3 is a block circuit diagram of a system illustrating the principles of the invention;

FIG. 4 shows a touch bar which may be employed in the implementation of the invention; and FIG. 5 is an enlarged view of one end of the touch bar, with the end cap removed, and showing a portion of the circuit board carrying the sensing circuitry.

DESCRIPTION OF THE PREFERRED EMBODIMENT

Figure 2:
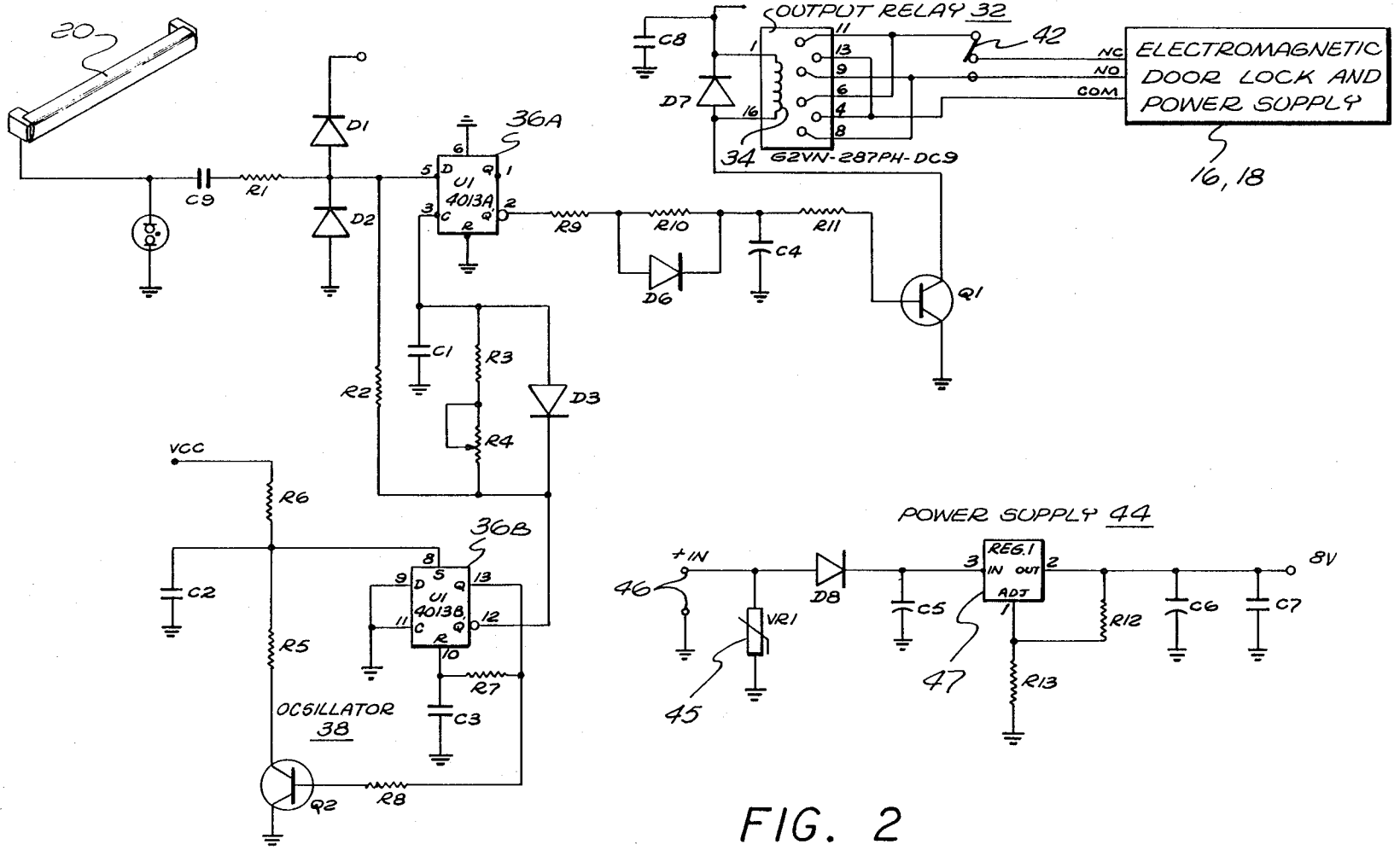
FIG. 2 is a circuit diagram of an electrical circuit implementing the sensing arrangements of the invention.

Referring more particularly to the drawings, FIG. 1 shows a door 12 and a door frame 14. Secured to the door frame is a large electromagnet 16 which, together with the striker plate or armature 18 on the door forms an electromagnetic lock. On the inside of the door and mounted thereon, is the touch bar 20 mounted to the door 12 by two insulating blocks which are not clearly visible in FIG. 1, but which are better shown in FIG. 4 of the drawings as elements 22 and 24. In order to gain access to the other side of the door 12, a coded input panel 26 is provided.

However, when egress from the area on the other side of the door 12 is desired, a person merely touches or pushes against the touch bar 20 and the result is to release the electromagnetic locking arrangements 16, 18, so that the door 12 may be pushed open. The precise mode of de-energization of the elecromagnetic lock 16, 18, will be discussed in greater detail hereinbelow.

In FIG. 2, the touch bar 20 is shown at the upper left, and the electromagnetic door lock is shown toward the upper right, at 16, 18. The switch by which the electromagnetic lock is de-energized is shown at 32.

With regard to the circuit arrangements for energizing the coil 34 associated with relay 32, this is accomplished by the circuitry associated with the chip 36A and 36B, which is actually a single chip but includes two flip flop circuits designated 36A and 36B which perform different functions in the circuitry. The flip flop 36B is part of the oscillator 38 which appears at the lower left in the circuit, and which generates a square wave as the flip flop alternates from one state to the other at a frequency of about 5 kilohertz under the timing control of the associated resistor and capacitance, which turn the transistor Q-2 on and off.

Now, referring to circuit 36A, the state of the flip flop included in this circuit depends on a relative timing of the clock pulse applied to pin 3 and the variable input applied to pin 5. The clock pulse applied to pin 3 is dependent on the timing established by the capacitor Cl, and the resistance R3 and variable resistor or potentiometer R4. Thus, the build-up of the signal being applied to terminal 3 of circuit 36A may be controlled by varying the potentiometer R4, and this in turn changes the sensitivity of the entire system. Square wave signals from the oscillator circuit 38 are also applied through the resistors R2 and R1 to the capacitor C9 and to the touch bar 20. Normally, the rise time of the pulse applied to terminal 5 of circuit 36A is prior to the arrival of the reference pulse at terminal 3, so the flip flop in circuit 36A remains in its same state, with pin 2 at a low potential. However, when the capacitance of the touch bar 20 is significantly increased, the rise time of the pulse applied to terminal 5 of circuit 36A is increased, so that it arrives subsequent to the clock pulse applied to terminal 3. This changes the state of the flip flop so that output Q' at terminal 2 of the circuit 36A goes positive, thereby turning on transistor Q-1, and operating coil 34 of relay 32. This breaks the circuit designated NC (for Normally Closed) to the magnetic lock 6, 18, so that the door is released.

A push button switch 42 which is normally closed, is located on the underside of the touch bar 20. In the event that the electromagnetic door lock does not release when a person is seeking egress and touches the bar 20, the switch 42 may be depressed and opened, thereby opening the circuit to the electromagnet 16 and releasing the door.

The power supply circuit 44 is conventional and includes an input at terminals 46 which may be 10 volts to 30 volts DC or 7 volts to 24 volts AC. At the right hand side of the circuit 44, an output voltage of 8 volts is provided for energization of the remainder of the data processing circuitry. Component 45 is a transient suppressor which may be purchased under the designator "VR1-ERZCOZD-K470"; and power supply chip 47 may be purchased under part number LM317T. The remaining circuit components not specifically mentioned hereinabove are generally conventional and may be implemented by the circuit components of the type shown in the circuit diagram.

FIG. 3 is an overall block diagram showing the touch bar 20, the electromagnetic lock 16, 18, and the power supply 44. Associated with the bar 20 in FIG. 3 is the sensor circuitry of FIG. 2. As indicated in the block diagram of FIG. 3, the electromagnetic lock 16, 18 is normally energized through the normally closed contacts included in the sensor circuitry and when these normally closed contacts are opened, the electromagnetic lock 16, 18 is turned off and egress through the door is permitted.

FIG. 4 is an enlarged showing of the touch bar which may be employed in the implementation of the present invention. The touch bar 20 includes two insulating blocks 22 and 24 by which the unit may be mounted to a door, and end caps 50 and 52 which enclose the hollow interior of the touch bar 20. The push button switch 42 is located on the side of the touch bar 20 which faces the door, and this normally closed push button switch serves the emergency release function described hereinabove in connection with switch 42 as shown in the circuit diagram of FIG. 2.

FIG. 5 is an enlarged view of one end of the touch bar 20 with one of the end caps removed. The mounting block 22 is visible, and the printed circuit board 56 is shown mounted in grooves in the two members 58 and 60 which extend from the side walls of the aluminum touch bar 20. The printed circuit board 56 is provided with wiring of a sufficient extent so that the printed circuit board may be connected to the wiring, to the push button, and to an external power source, with the printed circuit board outside of the touch bar 20, and may then be slid into its final assembled position in the slots of the members 58 and 60. The end cap, not shown in FIG. 5, is then secured in place to close the assembly.

In conclusion, it is to be understood that the foregoing detailed description and the accompanying drawings are illustrative of the principles of the invention. Various alternatives and variations may be employed without departing from the principles of the invention. Thus, by way of example and not of imitation, the touch bar 20 may be circular in configuration rather than rectangular; other electrical components may be employed to implement the function of the components shown in the circuit of FIG. 2; and a different electromagnetic lock may be employed other than that shown at 16, 18. Also the aluminum touch bar 20 could be formed of a high strength plastic with an inner conductive layer extending for a substantial portion of the area of the bar facing away from the door. Accordingly, the present invention is not limited precisely to the arrangements as shown and described hereinabove.

What is claimed is:

1. A quick release locking system comprising:

electromagnetic locking means for maintaining a door closed;

switch means for releasing said electromagnetic locking means to permit opening of the door;

circuit means having an input sensitive to increased capacitance for operating said switch means; and a touch bar, including an extended conductive member coupled to the input to said circuit means, and means for mounting said bar on a door;

whereby when said bar is touched or pushed by a person seeking to pass through the door, the locking means is released and the door is free to open.

2. A system as defined in claim 1 where said circuit means is mounted in said bar.

3. A system as defined in claim 1 further comprising push button switch means for releasing said electromagnetic locking means, mounted on said bar.

4. A system as defined in claim 1 wherein said circuit means includes (a) flip flop circuit means for operating said switch means, said flip flop circuit means including a clock input and a variable input for changing the state of said flip flop only when the variable input follows the clock input;

(b) a square wave oscillator;

(c) means for applying the output from said square wave oscillator to said clock input to provide a reference timing signal, and to said variable input with a delay dependent on the capacitance seen at said bar, whereby persons touching said bar delay the variable input and change the state of said flip flop circuit means.

5. A system as defined in claim 1 wherein said electromagnetic locking means is a large electromagnet and a strike plate or armature, mounted with one on the door frame and the other on the door.

6. A system as defined in claim 1 wherein said circuit means is mounted on a printed circuit board, and wherein said bar includes a pair of grooves for removably receiving said printed circuit board.

7. A system as defined in claim 1 wherein said bar is rectangular and insulated block means are provided for mountnng said bar to said door.

8. A touch operated control system comprising:

means having two states controlling a physical action;

switch means for changing the state of said controlling means;

circuit means having an input sensitive to increased capacitance for operating said switch means;

a touch means, including an extended conductive member connected to the input to said circuit means;

means for mounting said touch means where it may be manually touched by a person desiring to actuate the controlling means;

said circuit means including (a) flip flop circuit means for operating said switch means, said flip flop circuit means including a clock input and a variable input for changing the state of said flip flop only when the variable input follows the clock input;

(b) a square wave oscillator;

(c) means for applying the output from said square wave oscillator to said clock input to provide a reference timing signal, and to said variable input with a delay dependent on the capacitance seen at said bar, whereby persons touching said bar delay the variable input and change the state of said flip flop circuit means.

9. A touch operated control system as defined in claim 8 wherein said means for controlling a physical action is an electromagnetic lock.

10. A touch operated control system as defined in claim 8 wherein said touch means is a bar, and means are provided for mounting said bar on a door.

11. A system as defined in claim 10 where said circuit means is mounted in said bar.

12. A system as defined in claim 10 further comprising push button switch means for changing the state of said controlling means mounted on said bar.

13. A touch operated control system comprising:

electric means having two states for controlling a physical action;

switch means for changing the state of said controlling means;

circuit means having an input sensitive to increased capacitance for operating said switch means;

a touch bar, including an extended conductive member connected to the input to said circuit means, and means for mounting said bar on a door; and push button switch means for releasing said electromagnetic locking means, mounted on said bar;

whereby when said bar is touched or said push button is pushed by a person seeking to pass through the door, the electric means is switched from one state to the other.

14. A system as defined in claim 13 where said circuit means is mounted in said bar.

15. A system as defined in claim 13 wherein said circuit means includes (a) flip flop circuit means for operating said switch means, said flip flop circuit means including a clock input and a variable input for changing the state of said flip flop only when the variable input follows the clock input;

(b) a square wave oscillator;

(c) means for applying the output from said square wave oscillator to said clock input to provide a reference timing signal, and to said variable input with a delay dependent on the capacitance seen at said bar, whereby persons touching said bar delay the variable input and change the state of said flip flop circuit means.

16. A touch operated control system as defined in claim 13 wherein said electric means for controlling a physical action is an electromagnetic lock.

17. A system as defined in claim 13 wherein said circuit means is mounted on a printed circuit board, and wherein said bar includes a pair of grooves for removably receiving said printed circuit board.

18. A system as defined in claim 13 wherein said bar is rectangular and insulated block means are provided for mounting said bar to said door.

* * * * *